United States Patent [19]

Schenk

[11] 4,074,404

[45] Feb. 21, 1978

[54] APPARATUS FOR CONTROLLING APPLICATION OF WARP SECTIONS DURING WARPING

[75] Inventor: Kurt Schenk, Degersheim, Switzerland

[73] Assignee: Maschinenfabrik Benniger AG, Uzwil, Switzerland

[21] Appl. No.: 789,545

[22] Filed: Apr. 21, 1977

[30] Foreign Application Priority Data

Apr. 23, 1976 Switzerland ..... 5124/76

[51] Int. Cl.[2] ..... D02H 13/26

[52] U.S. Cl. ..... 28/185; 28/191; 28/194

[58] Field of Search ..... 28/185, 191, 194, 190; 226/110; 242/36, 186, 45, 75, 147

[56] References Cited

U.S. PATENT DOCUMENTS

| | | | |
|---|---|---|---|
| 1,096,702 | 5/1914 | Fleischer et al. | 28/191 X |
| 2,252,419 | 8/1941 | Slaughter | 28/194 X |
| 2,674,110 | 4/1954 | Roughsedge et al. | 28/191 X |
| 2,688,789 | 9/1954 | Durgee | 28/194 X |
| 3,409,194 | 11/1968 | Whitehead | 28/194 X |
| 3,599,300 | 8/1971 | Timbie | 28/185 |
| 3,777,959 | 12/1973 | Seneg | 28/185 X |

*Primary Examiner*—Louis K. Rimrodt
*Attorney, Agent, or Firm*—Werner W. Kleeman

[57] ABSTRACT

An apparatus for controlling the application of warp sections during warping, wherein a winding of predetermined length of warp threads and application height should be exposed to a warping operation wherein successive threads withdrawn from the bobbins of a bobbin creel and each delivered by means of a stop motion, thread brake to a warping reed and at that location formed into a warp section upon the winding drum of a winding machine. According to the invention there are provided means for calculating at any point in time a theoretical, momentary reference-application of the wound-up warp sections on the basis of fixed data inherent to the material undergoing warping and the number of revolutions of the winding drum. Further, means serve to measure at the same point in time the actual application, and means are provided for comparison of the calculated momentary reference-application with the measured momentary actual-application at such point in time and for generating a signal in the presence of deviations, this signal bringing about a correction by adjusting the thread tension of the thread withdrawn from the creel.

8 Claims, 10 Drawing Figures

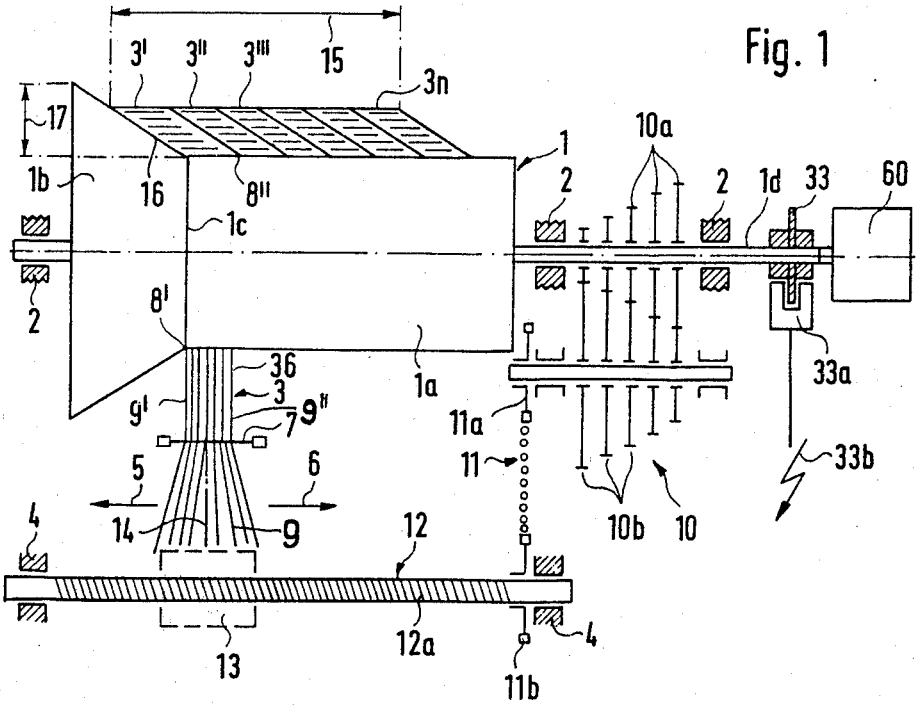
Fig. 1
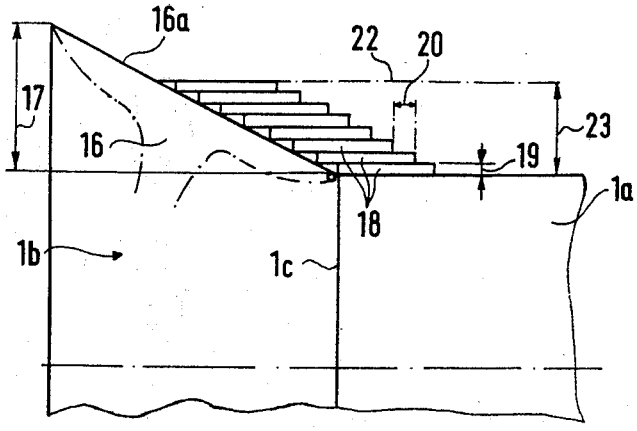
Fig. 2
Fig. 3a
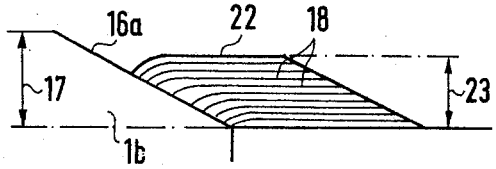
Fig. 3b
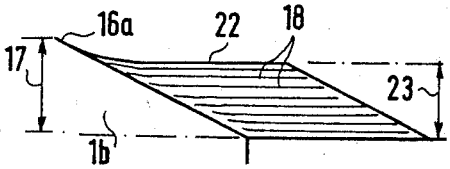

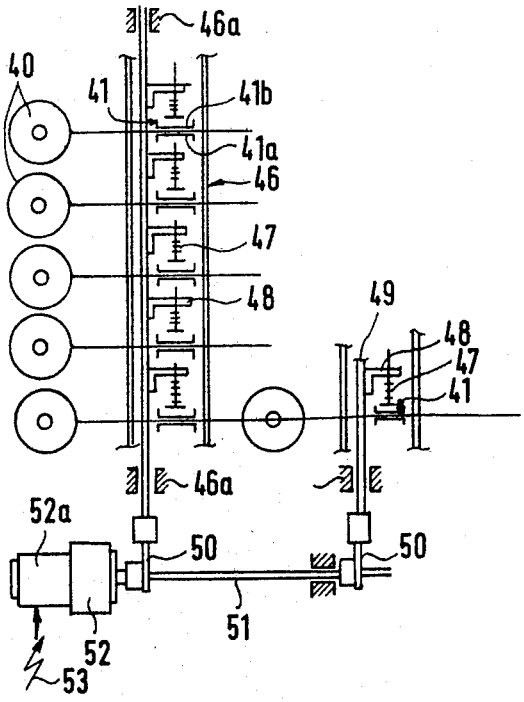
Fig. 8
Fig. 9
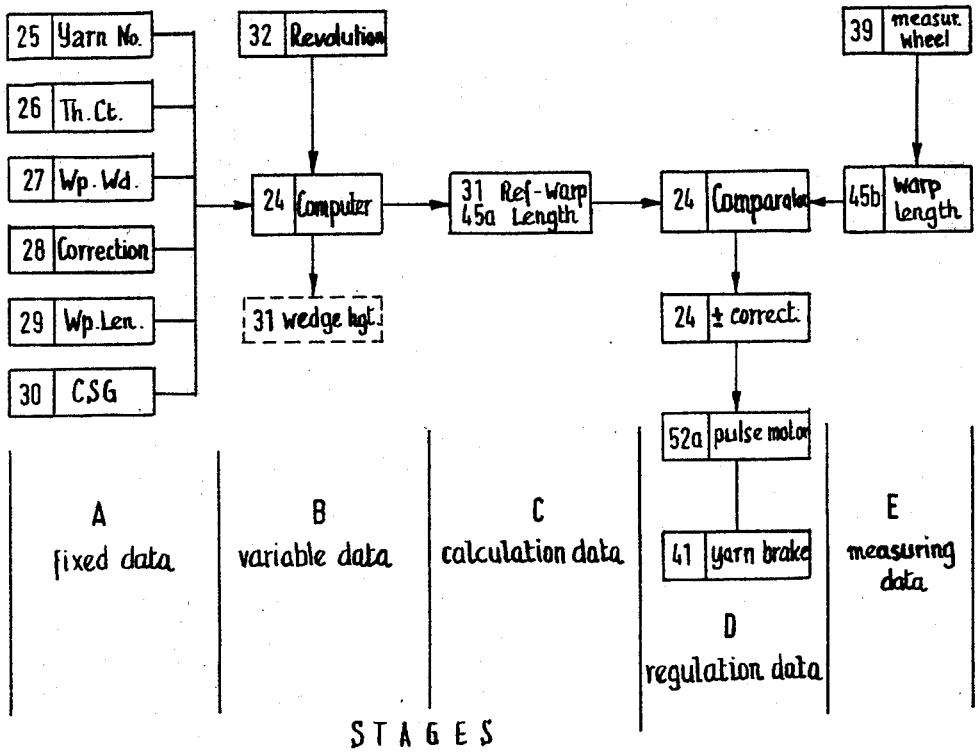

APPARATUS FOR CONTROLLING APPLICATION OF WARP SECTIONS DURING WARPING

BACKGROUND OF THE INVENTION

The present invention relates to a new and improved construction of apparatus for controlling the application of warp sections during warping operations, wherein there should be subjected to warping a winding of predetermined length of warp threads and application height from threads withdrawn in succession from the bobbins of a bobbin creel and each delivered through the agency of a stop motion and thread brake to a warping reed and at that location formed into a warp section upon the winding drum or reel of a warping machine.

In contrast to beam warping, during warping it is known to wind-up upon a warping drum or reel a number of warp sections next to one another, each composed of a multiplicity of threads or the like withdrawn from a bobbin creel. Thereafter, during beaming, these warp sections can be simultaneously wound onto a weaver's beam or back beam.

While heretofore for reasons of capacity, but also because of the increasing error- and disturbance sources, the maximum length of the warp ends or threads which are to be wound-up during the warping operation, the so-called warp length, was limited, at the present time it is desired to warp during a warping operation the greatest possible length of warp. Thereafter, such wound-up warp ends are wound onto a back beam in order to reduce the downtimes and manual operating times which result during each change-over operation both at the warping machine as well as also in the weaving mill at the loom, and thus, to obtain an increase in the production capacity or output.

Such capacity increase, as the same can be obtained by increasing the length of the warp which is to be subjected to the warping operation, of course requires not only appropriately wound bobbins for the bobbin creel, rather it also requires an increase of the winding diameter upon the winding drum an therefore the application height at such drum. The production of such bobbins is readily possible and the present day warping installations generally are completely capable of processing larger warp lengths, since as will be apparent from principles concerning surfaces or sheet-like areas, even relatively slight increase of the bobbin diameter and the application height, enables taking-up considerable increased length. The problems which hinder, or even prevent, increasing production in the described manner are attributable to disturbance factors which, with increasing application of the warp threads at the warping drum, quickly result in rendering impossible a correct beaming following the warping operation.

Such disturbance factors are, for instance, the different travel speeds of the warp ends or threads, attributable to the periphery or circumferential increase (as a general rule there is provided a correction device for maintaining constant the speed, but the correction increments or steps are too large); the increase of the thread tension due to the decrease of the bobbin diameter during progressive winding, resulting in increasingly harder winding and thus leading to reduced application, and the contamination or soiling of the warp threads or ends which occurs during winding and the start-up of the installation, and especially the thread brakes, which likewise cause an increase in thread tension and thus a reduction in the application of the warp sections.

Since the warp which has been beamed by the warping drum in each instance consists of a number of individual warp sections, the last-mentioned disturbance factors in particular result in a reduction of the bobbin diameter and contamination and heating of the installation, which notwithstanding the same setting of the warping machine, application of the first warp section does not correspond to that of the last warp section. In other words: the last warp section possesses a smaller application, leading to difficulties during subsequent beaming, when, as is the case during beaming, all of the warp sections are collectively simultaneously rewound. Since then the first warp section exhibits a greater application, thus also possesses a larger outer or external diameter than the last warp section with smaller outer diameter, then, when the difference exceeds a predetermined value, during beaming, for instance the last warp section is wound-up quite tautly, whereas the first warp section hangs-through loosely. Since after each revolution there is always wound-up more material at the first warp section than at the last warp section, it is possible in the presence of two great differences between both applications that there can no longer be wound-up any correct warp beam and the material subjected to the warping operation must be rejected.

The affect of the tension difference and equally that of the contamination of the installation can be neglected in the case of appreciably shorter warp thread lengths and smaller application heights derived therefrom, and accordingly, also smaller differences between the full bobbin and empty bobbin.

Further disturbance factors which heretofore opposed a desired increase in the length of the warp ends of threads which were to be exposed to the warping operation, also can be attributed to the thread material which is to be processed, especially during the processing of staple fibers. While it is possible when processing endless threads to wind such with existing installations into larger warp lengths due to the compactness and the lower frictional resistance thereof, during the warping of staple fibers owing to their more voluminous and aerated structure and, as a general rule, their larger diameter, there are present further obstructions. Not only does there result, with the same warp length, during warping of staple fibers, a considerably greater application than in the case of endless fiber material, but this greater application in conjunction with the properties of staple fibers has the result that such material reacts extremely markedly upon the heretofore mentioned disturbance factors.

In particular, the increase of the thread tension which arises in the creel owing to the decrease of the bobbin diameter, has particularly negative effects during warping of staple fibers, since during the winding of a thread warp section, it is desirable that the winding be harder at the inside, whereas at the outside the windings should be more loosely dispositioned. If, on the other hand, owing to increased thread tension the outer application is wound harder than the inner, then there occurs a pressing into the softer inner core, which can result in the warp end-application laterally sliding off and destroying the warp. Additionally, the winding or lap can float, with the result that the outer thread layers tend to rotate relative to the inner layers.

Also interruptions of the winding process, for instance for the insertion of divider cords or tapes into the wound warp sections for the purpose of subdividing the entire wound warp length or for repairing thread rupture or replacing depleted bobbins, can result in undesired differences in the application height of the finished winding or lap.

SUMMARY OF THE INVENTION

Hence, with the foregoing in mind it is a primary object of the present invention to provide apparatus for the improved control of the application of the warp sections during warping.

Another and more specific objects of the present invention aims at the provision of a new and improved construction of apparatus for controlling the application of warp sections during warping, which, while not eliminating the aforementioned disturbance factors, nonetheless however due to their continual control and appropriate correction of the warping operation, can control such warping operation in a manner such that all of the wound warp sections of a warp chain possess as closely as possible the same application height from the warping drum or reel and thus, practically also the same warp length.

Now in order to implement these and still further objects of the invention, which will become more readily apparent as the description proceeds, the apparatus of the invention contemplates the provision of means in order to calculate at any point in time a theoretical reference-application of the wound-up warp sections on the basis of fixed data which is inherent to the material which is to be subjected to the warping operations and the number of revolution of the winding or warping drum of the warping machine. Further, means are provided in order to measure at the same point in time the actual application and means serve to compare the calculated reference-application with the measured actual-application and in the presence of deviations deliver a signal which carries out a correction by an adjustment of the thread tension of the threads withdrawn from the creel.

BRIEF DESCRIPTION OF THE DRAWINGS

The invention will be better understood and objects other than those set forth above, will become apparent when consideration is given to the following detailed description thereof. Such description makes reference to the annexed drawings wherein:

FIG. 1 schematically illustrates enough of the significant parts of a warping machine for explaining the underlying concepts of the present invention;

FIG. 2 illustrates details of the cone region of the warping drum or reel of the machine of FIG. 1 for explaining the operations during warping, especially the first warp section;

FIGS. 3*a* and 3*b* schematically illustrate respective faulty warp application due to inaccurate adjustment of the warping cone or wedge height;

FIG. 8 illustrates a detail of the creel shown in FIG. 7 for portraying means for the simultaneous regulation of all of the thread brakes of the creel; and FIG. 9 is a flow diagram of a warping installation equipped with the inventive apparatus.

DETAILED DESCRIPTION OF THE PREFERRED EMBODIMENTS

Describing now the drawings, in FIG. 1 reference 1 designates a conventionally constructed warping drum or reel, which in standard fashion is mounted at both ends in the bearings 2 of a not further illustrated machine frame. Moreover, as indicated in FIG. 1 this warping drum 1 can be rotatably driven by any suitable drive motor 60.

Figure 7:
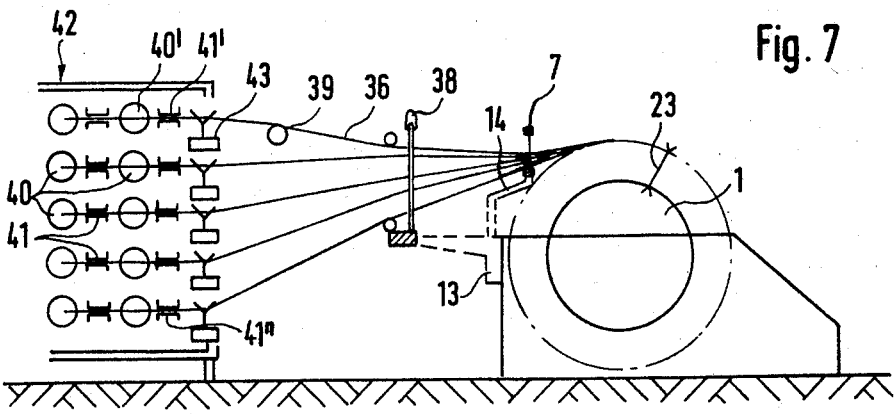
FIG. 7 is a schematic side view of a warping installation with creels, warping machine and a device of the type shown in FIG. 6.

The warping drum 1 will be seen to comprise a substantially cylindrical portion 1*a* at one end of which there adjoins the warping cone 1*b* which is usually displaceable in a manner well known in the art and which, in accordance with the inclination of the cone, supports successively wound layers of the warp sections. Each warp section 3 consists of a multiplicity of individual threads or ends 9 which are withdrawn from the bobbins 40 which are mounted upon bobbin or warp creel 42 and can be guided in a proper position and in a predetermined sequence and number in a reed 7 (FIG. 7).

At the beginning of the warping process the first warp section 3' is placed at its application or point of attack 8', and its first thread or end 9', illustrated at the left of FIG. 1, comes to bear at the line of contact 1*c* between the cylindrical portion 1*a* and the cone 1*b*. Now the warping drum 1 is placed into rotation by the drive motor 60 and the first warping section 3' is wound-up. Control of deposition of the threads or ends along the warping cone 1*b* is accomplished through the intermediary of change-speed gearing 10 having a multiplicity of driving gears 10*a* and driven gears 10*b*. The selection and purpose of the change-speed gearing or transmission 10 will be explained more fully hereinafter. The specific one of the change-speed gears 10*b* which is driven, in turn drives by means of a sprocket gear or wheel 11*a* and a chain 11 a sprocket gear or wheel 11*b* which is rigidly connected for rotation with a warping carriage-displacement spindle 12. This threaded displacing or displacement spindle 12 in turn is mounted in bearings 4 (FIG. 1) of the machine frame. Engaging with the threading 12*a* of the spindle 12 is the schematically indicated warping carriage 13 which carries by means of a holder 14 the reed 7.

Rotation of the warping drum or reel 1 in the direction of winding brings about, by means of the change-speed gearing 10 and the sprocket chain drive 11, rotation of the threaded spindle 12 and thus a displacement or shifting of the warping carriage 13. Due to the movement of the warping carriage 13 there is also correspondingly displaced the reed 7 which guides the warp section in the direction of the arrow 5, so that the warp section, as illustrated, is wound at an inclination along the warping cone 1*b*.

After reaching the desired length of the warp chain which is subjected to the warping operation, then the warping drum 1 is stopped. Hence, winding of the first warp section 3' is completed. Now the warping carriage 13 is decoupled from the threaded spindle 12 and displaced back in the direction of the arrow 6 to such an extent until the first left-hand thread 9' of the warp section 3'' which is to be newly wound comes to lie adjacent the last thread 9' of the just wound warp section 3', i.e. is located at the new contact or application point 8''.

Now in the same manner as for the first warp section 3', and subsequent to the warping operation carried out thereat, the second warp section 3'' is exposed to the warping operation until reaching the same length upon the winding or warping drum 1 and the operation is repeated with the further warp sections 3''' to **3*n* until the warp chain has undergone the warping operation at the drum 1 over its full width 15 (FIG. 1**).

The warping cone **1*b*, as already mentioned, is of an adjustable construction in the exemplary embodiment under discussion. Hence, for this purpose it consists of a multiplicity of wedge or cone elements 16 (FIG. 2), which, in the manner of an umbrella, can be pivoted into different inclined positions and fixed thereat by any suitable and conventional pivoting means which here therefore have not been further shown. In the discussion to follow there will now be considered the effect of the wedge height 17 (FIG. 2**) which can be adjusted in this manner.

If it is assumed that for each revolution of the warping drum or reel 1 there is applied a warp section layer 18 having a thickness 19 and there occurs by means of the change-speed drive or transmission after each revolution such a displacement of the warping carriage 13 in the direction of the arrow 5 that during the next revolution of the drum 1 the next warp section layer 18 is shifted through the spacing or distance 20 and wound-up, and the adjustment is so optimum that the winding takes place exactly along the cone surface **16*a* and the surfaces of the successively wound warp section layers 18 always extend exactly parallel to one another and to the cylindrical portion 1*a* of the drum 1**.

Due to the close relationship between the feed of the warping carriage 13 in the direction of the arrow 5, selected by the change-speed gearing 10, the adjusted wedge height 17 and the warp section thickness 19, it is necessary for this purpose that all three values, namely displacement, warp section thickness and wedge position be exactly coordinated to one another.

However, the warp section thickness 19, which in their totality form the application to the warping drum 1, themselves are dependent upon different factors, which even with the most careful determination of all data can lead to errors.

In FIGS. **3*a* and 3*b* there have been illustrated ascendingly poor and unuseable warp section applications 23, as such can be formed due to non-optimum warp section deposition, i.e. a faulty coordination or matching of the warp section layer displacement 20, warp section thickness 19 and wedge height 17**.

Since the momentary warp section layer displacement 20 is determined by the change-speed gearing 10 (such can only be altered in large stages or steps, which cannot be used for correction purposes), in the first instance it is necessary to more closely check both of the other parameters. The warp section thickness 19 is apparently that magnitude which has the greatest influence upon the entire winding process. Its value is dependent upon many individual factors, which will be explained more fully hereinafter. The wedge height 17 itself is a value, which, as also will be explained more fully hereinafter, can be theoretically determined from textile data, but likewise is associated with a disturbance magnitude. In other words: both the warp section thickness 19 as well as also the wedge height 17 constitute values, the magnitudes of which are basic with respect to the disturbance magnitudes or values. Their affect is such that, as shown in FIG. **3*a*, the warp section-upper edge 22 drops in relation to the wedge surface 16*a* when the wedge height 17 has been adjusted too low and, a shown in FIG. 3*b*, bears against such wedge surface when the wedge 17** is adjusted too high.

The advantage of the umbrella-like movable warping cone **1*b* therefore resides in the fact that upon the occurrence of such error or defect, it is possible to undertake corrective measures by changing the wedge height 17**, in order to reestablish the parallelism of the warp section surfaces.

The adjustability of the wedge height 17 therefore forms a first correction device for obtaining a faultless winding of the first warp section 3'. If, however, the first warp section 3' is correctly wound upon the warping or winding drum 1, then, provided that there do not occur any technical errors in operation, for instance, inaccurate point of application of the following warp sections, the correct winding of the successive warp sections 3'', 3''' to **3*n*** is ensured.

In contrast, as concerns the momentary warp section thickness 19, this is dependent upon the yarn number or count, the total number of threads or ends, the warp width and a correction factor. While the first three of the aforementioned parameters can be derived from the warp disposition, in the latter there are taken into account all textile technological data, for instance whether the material is voluminous, dyed or undyed, twisted to a greater or lesser extent, whether the material consists of endless- or staple fibers, and the thread tension and thread speed which is employed.

As a general rule, such correction factor is determined in the laboratory and stored for further use and again reemployed when applying the same or similar wedge sections.

This correction factor, although it is dependent upon a great many parameters, can be readily determined, usually can be reproduced in a faultless manner and therefore comparatively unproblematic.

Figure 4:
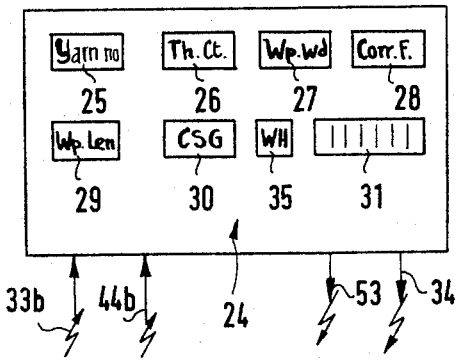
FIG. 4 is a simplified illustration of the operating positions for control of the application of the warp sections.

The warping machine is equipped with a processor which, on the one hand, constitutes a data carrier and storage and, on the other hand, determines data for the warp production. In FIG. 4 there is schematically illustrated the operating console or panel of this processor which is generally indicated by reference character 24 and incorporating the indicators or displays which are here of interest, the operating buttons or knobs, and the inputs and outputs.

By means of conventional preselector switches 25, 26, 27, 28, 29 and 30 it is possible to set in this processor 24 the values which are significant for a predetermined warp operation and to store such for the entire warp process. In particular, at the switch 25 there is set the yarn number (Yarn Nr.) at the switch 26 the total thread count (Th. Ct.), at the switch 27 the warp width (Wp. Wd.), at the switch 28 the correction factor (Corr. F.), at the switch 29 the warp length (Wp. Len.), and at the switch 30 the change-speed gearing (CSG).

Based upon the therein introduced technological textile data and the mechanical data the processor 24 is capable of computing the resultant mean or average warp section thickness 19 and derived therefrom, with the aid of the infed warp length, which is to be subjected to the warp operation, to calculate the number of revolutions of the warping drum or reel which are necessary in order to obtain this preselected warp length while taking into account the package or lap diameter which continually increases during the winding operation. In the processor 24 this value is continuously computed and the resultant momentary reference-warp length is digitally displayed in the data field or read-out window 31. Provided upon the warping drum shaft 1*d* is a pulse disc 33 having a pulse transmitter 33*a*. An electrical connection or line 33*b* leads from the transmitter 33*a* as the input to the processor 24. The pulses delivered from the pulse transmitter 33*a* to the processor 24 enable the latter, specifically in conjunction with the calculated warp section thickness for the infed fixed data, to compute at any point in time the warp length which theoretically should be wound-up at this point in time. This momentary reference-warp length, as already mentioned, is continuously digitally displayed in the read-out field or window 31. At the same time, this momentary reference-warp length is compared by the processor 24 with the warp length stored by means of the preselector switch 29. Upon reaching the latter, then the processor 24 delivers by means of the line or conductor 34 an output signal which, through the agency of not particularly illustrated electro-mechanical means of conventional design, immediated interrupts the winding operation and stops the machine and prepares such for winding the next warp section 3'', carries such out and completes the same.

To further augment the discussion it is here mentioned that prior to the start of the work, however after the infeed of the fixed data by the switches 25 to 30 which are decisive for the relevant warp or warping operation to be carried out, it is possible to initiate a further arithmetic or mathematical operation of the processor 24 by depressing one of the push buttons 35 (WH), by means of which there can be calculated the required or optimum setting of the wedge height 17 of the infed fixed data introduced by the switches 25 to 30. This calculated wedge height is displayed in the data or read-out field 31 is long as the push button 35 is depressed. This calculated and displayed value for the wedge height 17 is now transferred by the operator to the machine, prior to start of the warp or warping process, in other words the warping cone 1*b* is adjusted until it has obtained the computed wedge height.

The display of the calculated wedge height in the display or read-out field 31 extinguishes upon release of the push button 35, so that the read-out field 31 is free for the continuous indication of the momentary reference-warp length during the warp operation. During the interrogation of the wedge height, by depressing the push button 35, can be stored by suitable means.

In the introductory portion of this disclosure there has already been mentioned the impermissible conditions which result when, for instance, during the warping of staple fiber threads of greater length, the decreasing bobbin diameter and the contamination, produces an increase of the thread tension during the production of the different warp sections 3' to 3*n* and as a result thereof there is formed a decrease of the warp section application 23 from warp section to warp section.

Figure 5:
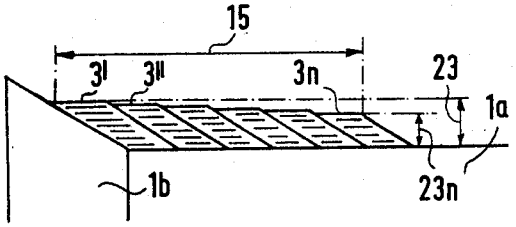
FIG. 5 is a schematic illustration of warp which has been improperly warped due to the effects of disturbance factors.

Now in FIG. 5 there has been illustrated a warp chain which has been subjected to a warping or warp operation, and possessing the previously described defects or flaws. The warp sections 3' to 3*n* are shown positionally correct at the warping drum or reel 1, i.e. have been wound-up in accordance with the adjusted or set warping cone 1*b*. Due to the different disturbing factors and the thus resulting always greater thread tension, the application height 23 has increasingly become smaller from the band 3' to the last band 3*n* and has now attained the value 23*n* for the last warp section 3*n* which has undergone the warp operation.

For the following beaming operation such faultily warped warp is unsuitable, because, if for the beaming operation all ends of the warp sections 3' to 3*n* are simultaneously drawn-off of the warping beam, then the first warp section 3' possessing the largest warp section application 23 will be wound very loosely, whereas the last warp section 3*n* with the smallest warp section application 23*n* will be wound extremely taut.

If the difference becomes too great between the warp section applications 23 and 23*n*, then the winding-off operation for beaming purposes can be placed in question.

The illustrated installation therefore possesses an apparatus which renders possible control of the warp section application in the sense that there is insured for equal application to the winding drum for all of the warp sections which have been exposed to the warping operation.

To this end, a random warp thread or end of the thread field which forms the warp section 3 which is to be exposed to the warping operation, preferably the last thread or yarn 36 at the right of FIG. 1, is not guided to be free as the remaining threads or yarns, rather as apparent from showing of FIG. 7, is guided between its stop motion 43 in the beaming creel 42 and the reed 38 of the installation by means of an extremely easily movable measuring wheel 39. The easy mobility is necessary in order that the measured warp ends or threads 36 have imparted thereto, in relation to the other warp threads of the warp section, a negligible thread tension increase due to the friction of the measuring wheel 39. Since each bobbin 40 of the creel has associated therewith a thread brake 41 the impact or action of the thread brake 41' of the bobbin 40' of the measured thread can be compensated in relation to the other thread brakes, up to the brake 41*n*, i.e. the friction increase in the thread 36 to be measured, can be compensated. This is important for the quality of the warp chain.

The yarn or thread brakes 41 have the function, on the one hand, of tensioning each individual warp thread to such an extent that it can be processed at the warping machine, and, on the other hand, also in the manner that the tension of all threads is the same. Of course, in this respect care is to be taken that the warp threads or ends are only braked to such an extent as such is necessary to obtain a proper warp chain. The stop motions 43 have the function of monitoring each warp thread or end, i.e. carrying out of a control of their presence. If a thread ruptures, then the related stop motion stops the warping machine immediated through the agency of not particularly illustrated means.

Figure 6:
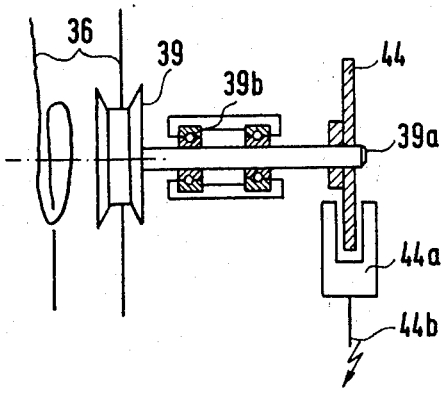
FIG. 6 illustrates a device for the continuous measurement of the wound-up length of a warp end or thread.

Advantageously, and as shown at the left-hand portion of FIG. 6, the warp end or thread 36 is looped once about the measuring or measurement wheel 39, in order to avoid measuring errors by sliding, since it should serve as the measuring thread for regulating and controlling the application or deposit 23 of the warp upon the drum 1 during the warping operation.

The measuring wheel 39, about which travels the measuring thread or yarn 36, is mounted upon its shaft 39*a* and ball bearings 39*b* and secured by means of a housing at the beaming creel 42. Seated upon the measuring wheel shaft 39*a* is an impulse or pulse disc 44 with which there is operatively associated a pulse transmitter 44*a*, the pulses of which are delivered by means of an electrical connection or line 44*b* as an input to the processor 24.

In the preceding discussion it was explained that the processor continuously calculates with the aid of the input pulses received by means of the input 33*b* from the transmitter 33*a* and the warp section thickness 29 computed on the basis of the infed fix data of the preselection switches 25 to 30, the theoretically wound warp length, i.e. the momentary reference-warp length and displays such result in the indicator or display field 31.

The pulses transmitted from the transmitter 44*a* of the measuring wheel 39, during operation of the installation, to the processor 24 by means of its second input 44*b* are used to enable the processor 24 to compare the theoretical length of the wound-up warp threads or ends computed by means of the first input 33*d* with the actual length of the wound-up warp threads infed by means of the second input 44*b*, because the measuring wheel 39 measures the momentary actual-warp lengths, and further, such processor thereby determines deviations and when such arise acts in a corrective manner upon the thread or yarn tension.

In the exemplary embodiment under discussion such is accomplished in the manner that in the presence of a difference between the calculated momentary reference-warp length and the measured momentary actual-warp length in the sense that the latter is smaller than the former, which means that the warp section application 23 is too small, then the processor 24 transmits a positive signal by means of its output 53. In reverse situation, i.e. when the measured actual-warp length exceeds the calculated momentary reference-warp length, which means that the warp section application 23 at the drum is too large, then the processor 24 delivers a negative signal by means of the same output 53. Such a negative signal can indeed arise during over-correction of the installation, whereas, as a general rule, due to the increase of the thread tension, brough about by decrease of the bobbin diameter and contamination, a thread tension increase and the therewith associated decrease of the warp section application 23 always produces the one positive signal.

These output signals are employed to adjust all of the thread brakes 41 associated with the bobbins 40 at the beaming creel 42, and specifically in such a manner that either the impingement i.e. braking action of the thread brakes is decreased when the actual - warp section application is smaller than the reference-warp section application, in other words in the presence of a positive signal, or the braking action of the thread brakes is increased when the actual-warp section application is greater than the reference-warp section application, in other words in the presence of a negative signal.

In Swiss Patent 452,452 there is disclosed a yarn or thread brake wherein also during the warping process, i.e. in fact continuously during the operation of the installation the braking action is increased or decreased and thus it is possible to change the thread or yarn tension in both directions. As shown in FIG. 8, in this respect the thread brakes 41 are arranged in the brake supports 46 of the beaming creel. Each bobbin 40 which is mounted in the creel has operatively associated therewith one such thread brake 41 which comprises two plates 41*a* and 41*b* which are pressed against one another by means of a compression or pressure spring 47, and thus, as a function of the adjustable spring force, brake to a greater or lesser extent, as the case may be, the thread which is passed between the brake plates 41*a* and 41*b*. In order to regulate the pressure in each instance each row of thread brakes is grouped together into a unit or assembly. Acting upon each pressure spring 47 is an angle member 48 or equivalent structure, and all of these angle members of a row are conjointly mounted at an adjustment rail 49 or other appropriate adjustment member, which is vertically guided at the bearing locations or bearing means 46*a*. Each adjustment rail 49 has operatively associated therewith an eccentric 50. The number of eccentrics or eccentric members 50 corresponds to the number of brake holders or supports 46. All of the eccentric members 50 are conjointly fixedly mounted upon an adjustment shaft 51 and can be adjusted by an adjustment drive 52 incorporating a pulse motor 52*a* which is flanged to the drive 52. An angular rotation of the adjustment shaft 51 causes, by means of the eccentric 50 a change in the position of the adjustment rail 49. This change, in turn, brings about that each angle member 48 likewise alters its spacing from the upper brake plate 41*b*. If the pressure spring 47 is relieved during lifting, then, the warp thread tension is reduced. During lowering of the angle member 48 the pressure spring 47 is compressed together a greater extent and acts with a larger force upon the upper brake plate 41*b*, resulting in an increase of the warp thread tension.

A corresponding change in the impingement or braking action of all of the thread brakes of a creel during the warping operation is also possible when using conventional thread brakes, the braking action of which is controlled electromagnetically.

Finally, there has been illustrated in FIG. 9 a flow diagram which portrays the most important functions. The individual stages have been divided in accordance with the course of the operations and have been indicated by reference characters A, B, C, D, and E.

At the stage A there is portrayed the fixed data which is set by the preselector switches 25 to 30. This data is received by the mill operator upon the program or work card and he correspondingly adjusts the machine. By means of this fixed data there is calculated in the processor 24 essentially two data, and specifically, the wedge height and the momentary reference-warp length. The wedge height can be recalled prior to the start of the working operation by means of the push button or key 35 and adjusted. For determining the momentary reference-warp length there is utilized the rotation of the drum as a variable magnitude. The stage B thus contains the so-called "variable data."

At the right-hand side of the flow diagram there is determined at the stage E, designated by the legend "measuring data," the momentary actual-warp length measured by the measuring wheel 39.

In the stage C, the so-called "calculation data," there appears a theoretically determined value, whereas in the stage E, the so-called "measuring data," there is determined the actual value.

Both such data are delivered into the stage D, the so-called "regulation data," and at that location are compared with one another in the comparator of the processor 24. Deviations of the actual-value from the stage E with respect to the reference value of the stage C are delivered as correction magnitude.

In the stage D, the "regulation data," there is further indicated that the plus-minus-correction is infed into the pulse motor 53 which thereafter adjusts the thread brake such that an equilibrium condition can be set between the momentary reference-application and the momentary actual-application.

It also can be possible that the correction, in the presence of fluctuating values related to the measuring data, results in an over-control in the stage D, the "regulation data," whereby, however, there must be immediately triggered a counter-control. Thus if by means of the measuring wheel 39 there is required, in relation to the calculated momentary reference-warp length, owing to the sudden occurrence of a large difference in the comparator, a large correction step, then this can have the result that there is exceeded the actual-warp length which is strived for. This in turn has the result that there is immediately initiated an opposite correction step.

In the previously discussed exemplary embodiment there is utilized a measuring wheel for determining the actually wound-up warp thread lengths, and the computed momentary reference-application or deposit is compared with a momentary actual-application which results from the measured warp section.

It is within the contemplation of the present invention completely possible and conceivable, to measure instead of through the foregoing arrangement the actual application or deposit, in other words the momentary actual-application by means of a photocell or by means of a feeler roller bearing upon the lap or winding, and to compare this value by means of the processor with the momentary reference-application computed on the basis of the infed fixed data and the drum revolutions and in the presence of deviations to trigger corrections in the same manner by altering the thread tension.

While there are shown and described present preferred embodiments of the invention, it is to be distinctly understood that the invention is not limited thereto, but may be otherwise variously embodied and practiced within the scope of the following claims.

What I claim is:

1. In an apparatus for controlling the application of warp sections during a warping operation, wherein a winding of predetermined length of warp threads and application height is exposed to a warping operation wherein successive threads withdrawn from the bobbins of a bobbin creel and each delivered by means of a stop motion and thread brake to a warping reed are formed at that location into a warp section upon a winding drum of a winding machine, the improvement comprising:

means for calculating at any point in time a theoretical, momentary reference-application of the wound-up warp sections on the basis of fixed data inherent to the material undergoing warping and the number of revolutions of the winding drum;

means for measuring at the same time the actual-application of the warp sections; and means for comparison of the calculated momentary reference-application with the measured momentary actual-application at such point in time and for generating a signal in the presence of deviations, which signal brings about a correction by adjusting the thread tension of the thread withdrawn from the creel.

2. The apparatus as defined in claim 1, wherein:

said means for measuring the actual-application comprises a measuring wheel driven by a thread of the warp section for measuring the wound-up warp thread length and thus indirectly the momentary actual-application at the winding drum;

said comparison means comprising a processor structured as a regulation- and computer device for receiving the measured values from the measuring wheel;

said processor comparing the actual-value with the continuously computed momentary reference-value and in the presence of deviations triggering a correction signal which electromechanically simultaneously alters the adjustment of all thread brakes of the creel in the sense of carrying out a correction.

3. The apparatus as defined in claim 1, wherein:

said means for measuring the momentary actual-application at the winding drum comprises photocell means which produces a measurement value;

said comparison means comprises a processor for comparing the measurement value with the computed momentary reference-value; and transfer means for transferring the measurement value to the processor.

4. The apparatus as defined in claim 1, wherein:

said means for measuring the actual-application comprises a feeler roller for directly measuring the momentary actual-application at the winding drum and producing a measurement value;

said comparison means comprising a processor for comparing the measurement value with the computed momentary reference-value; and transfer means for transferring the measurement value to the processor.

5. The apparatus as defined in claim 2, wherein:

said winding drum includes a shaft;

said means for calculating the momentary reference-application of the wound-up warp sections comprises a pulse disc seated upon said shaft and a pulse transmitter;

the pulse disc supplying by means of the pulse transmitter pulses to the processor for the arithmetic determination of the reference-application;

said measuring wheel including a shaft;

a pulse disc means seated upon the shaft of the measuring wheel;

pulse transmitter means provided for said pulse disc means;

said pulse disc means of the measuring wheel supplying by means of the pulse transmitter means pulses to the processor concerning the measured length of the thread traveling over the measuring wheel and therefore indirectly infeeding information concerning the actual-application to the winding drum.

6. The apparatus as defined in claim 2, wherein:

said measuring wheel is arranged along a given path of travel of the thread following the thread brake of the creel which is associated with the related thread and is secured to the creel.

7. The apparatus as defined in claim 2, wherein:

the thread brake of the associated thread which travels over the measuring wheel is set at a weaker setting than all other thread brakes of the creel in order to compensate for the additional thread tension produced by the measuring wheel.

8. The apparatus as defined in claim 1, wherein:

said comparison means comprises a processor;

a motor for simultaneously setting all of the thread brakes of the creel;

said processor deriving a correction signal which actuates said motor which simultaneously sets all of the thread brakes of the creel.

* * * * *